US010869508B2

(12) United States Patent
Huang et al.

(10) Patent No.: US 10,869,508 B2
(45) Date of Patent: Dec. 22, 2020

(54) ELECTRONIC CIGARETTE OF ELECTROMAGNETIC HEATING

(71) Applicant: Shenzhen First Union Technology Co., Ltd., Shenzhen (CN)

(72) Inventors: Yanzhou Huang, Shenzhen (CN); Zhongli Xu, Shenzhen (CN); Yonghai Li, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 365 days.

(21) Appl. No.: 16/012,740

(22) Filed: Jun. 19, 2018

(65) Prior Publication Data

US 2018/0360120 A1 Dec. 20, 2018

(30) Foreign Application Priority Data

Jun. 20, 2017 (CN) ..... 2017 20 718426 U

(51) Int. Cl.

| | |
|---|---|
| ***A24F 47/00*** | (2020.01) |
| ***H05B 6/10*** | (2006.01) |
| ***H05B 6/36*** | (2006.01) |

(52) U.S. Cl.

CPC ..... *A24F 47/008* (2013.01); *H05B 6/108* (2013.01); *H05B 6/36* (2013.01)

(58) Field of Classification Search

CPC ..... A24F 47/008

See application file for complete search history.

(56) References Cited

U.S. PATENT DOCUMENTS

| | | | | |
|---|---|---|---|---|
| 9,538,789 | B2 * | 1/2017 | Liu | A24F 47/008 |
| 2014/0261500 | A1 * | 9/2014 | Park | A61M 15/06 131/329 |
| 2018/0070637 | A1 * | 3/2018 | Deng | A61M 15/06 |
| 2018/0116288 | A1 * | 5/2018 | Hu | H05B 3/46 |
| 2018/0360120 | A1 * | 12/2018 | Huang | A24F 47/008 |
| 2019/0357592 | A1 * | 11/2019 | Zhu | A24B 15/167 |
| 2020/0060348 | A1 * | 2/2020 | Mironov | H05B 6/108 |
| 2020/0093177 | A1 * | 3/2020 | Han | A24F 40/46 |
| 2020/0128878 | A1 * | 4/2020 | Stura | H05B 6/06 |
| 2020/0163386 | A1 * | 5/2020 | Courbat | A24F 40/44 |

FOREIGN PATENT DOCUMENTS

| | | | |
|---|---|---|---|
| CN | 203 762 288 | U | 8/2014 |
| CN | 204 132 397 | U | 2/2015 |
| CN | 105 962 419 | A | 9/2016 |
| EP | 2 444 112 | A1 | 4/2012 |
| WO | 20150177045 | A1 | 11/2015 |
| WO | 20170001818 | A1 | 1/2017 |

* cited by examiner

*Primary Examiner* — James Harvey

(74) *Attorney, Agent, or Firm* — Proi Intellectual Property US; Klaus Michael Schmid

(57) ABSTRACT

An electronic cigarette of electromagnetic heating is disclosed including: an atomizer and a power supply; the atomizer has a hollow liquid conductor, an inner wall of the liquid conductor has a metallic net; a recessed cup body is disposed on a top of the power supply; an induction coil surrounds outside the recessed cup body, a bottom end of the atomizer is disposed in the cup body. The electronic cigarette provided therein has a simple structure, a small volume and is capable of inserting and drawing, and is convenient to use.

10 Claims, 5 Drawing Sheets

ELECTRONIC CIGARETTE OF ELECTROMAGNETIC HEATING

TECHNICAL FIELD

The present disclosure relates to the field of electronic cigarettes, and in particular, to an electronic cigarette of electromagnetic heating.

BACKGROUND ART

Smoking smog produced in a process of combustion of the tobacco materials has tens of carcinogens, such as tars etc., which may hazard human's health pretty much. Moreover, the smoking smog spreading in the air produces a second-hand smoke, once the second-hand smoke has been sucked by human, it would harm the health. Therefore, smoking is prohibited in public area. To satisfy some smokers' need, the electronic cigarettes appeared.

In the current market, the electronic cigarette realizes heating by using a heating wire, the shortage of the heating wire is slow reaction and low conductivity efficiency. The temperature can't be accurately controlled so that the smoking smog contains a burnt flavor. A Chinese patent CN201420564863.7 published an atomizer and an electronic cigarette having the same, a coil of which produces a high-frequency current as well as produces a fast pace changing magnetic field. Magnetic heater generates vortex and heat in the magnetic field, enabling the tobacco liquid to be atomized.

The electronic cigarette of electromagnetic heating in the current market generally utilizes an induction coil fixed on the atomizer, connected with the power supply by a wire or thread, which may complicate the structure of the atomizer of the electronic cigarette to have a big size and narrow appearance design.

SUMMARY

In view of the drawbacks in the electronic cigarette and the atomizer thereof known to the inventors, the present disclosure generally relates to an electronic cigarette of electromagnetic heating with an atomizer in a simpler structure and a smaller size.

To overcome the above shortages, the present disclosure relates to an electronic cigarette of electromagnetic heating including: an atomizer and a power supply; the atomizer has a hollow liquid conductor, inner wall of the liquid conductor has a metallic net; a recessed cup body is disposed on a top of the power supply; an induction coil surrounds outside the recessed cup body, a bottom end of the atomizer is disposed in the cup body.

The atomizer has a hollow atomizing tube; an aerosol pipe is disposed at a center of the atomizer; between the atomizing tube and the aerosol pipe defines a liquid storage chamber; an air inlet is disposed at a bottom of the atomizer, the air inlet is in communication with the aerosol pipe.

The liquid conductor is disposed between the air inlet and the aerosol pipe. The liquid conductor is a hollow circular structure, guided to the liquid storage chamber.

The bottom of the atomizer comprises a side hole, the side hole is communicated with the air inlet.

The liquid conductor is a liquid conducting cotton or a porous ceramic body.

The power supply further comprises a built-in battery cells, a control circuit board, a charging seat and a switching button.

The charging seat is disposed at a lowest end of the power supply and is configured for charging the battery cells; the control circuit board is connected with the battery cells and the induction coil; the switching button is disposed outside the power supply.

A recess is disposed on a top of the power supply, the cup body is disposed inside the recess, an inner diameter of the cup body is greater than an outer diameter of the atomizer.

A cover component is disposed on a top of the cup body, the cover component is used to compact the cup body and the induction coil tightly.

A through hole is disposed at a mid-part of the cover component, a diameter of the through hole allows the bottom end of the atomizer to be inserted into; the cover component further has a plurality of ancillary holes distributed around the through hole.

Additional aspects and advantages of the present disclosure will be: the atomizer and the power supply are connected by means of interactive intersection; the atomizer has no need of connecting with the power supply, reducing the number of the components that are electrically connected to the battery cells, simplifying the structure and replacing the atomizer more conveniently, therefore aiding use of the disposable electronic cartridge. The cup body of the power supply will entirely hold the bottom end of the atomizer, avoiding the tobacco liquid of the traditional electronic cigarette flowing downward to damage the control circuit board.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
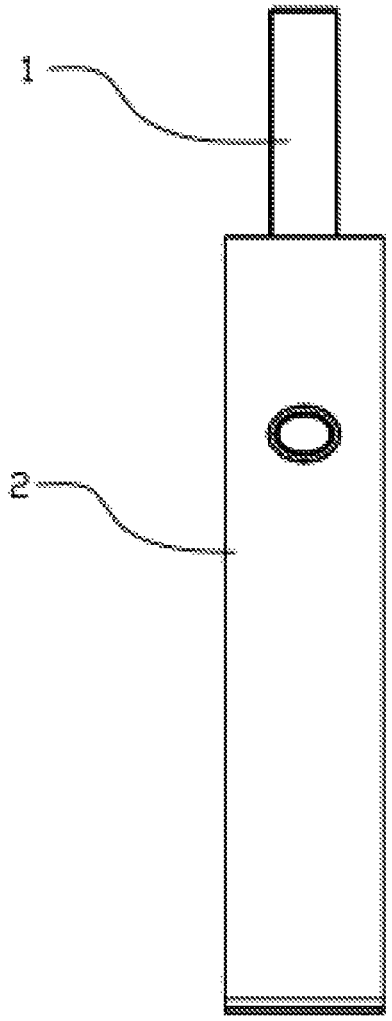
FIG. 1 is an front aspect view of an electronic cigarette of electromagnetic heating according to an embodiment of the present disclosure.
Figure 2:
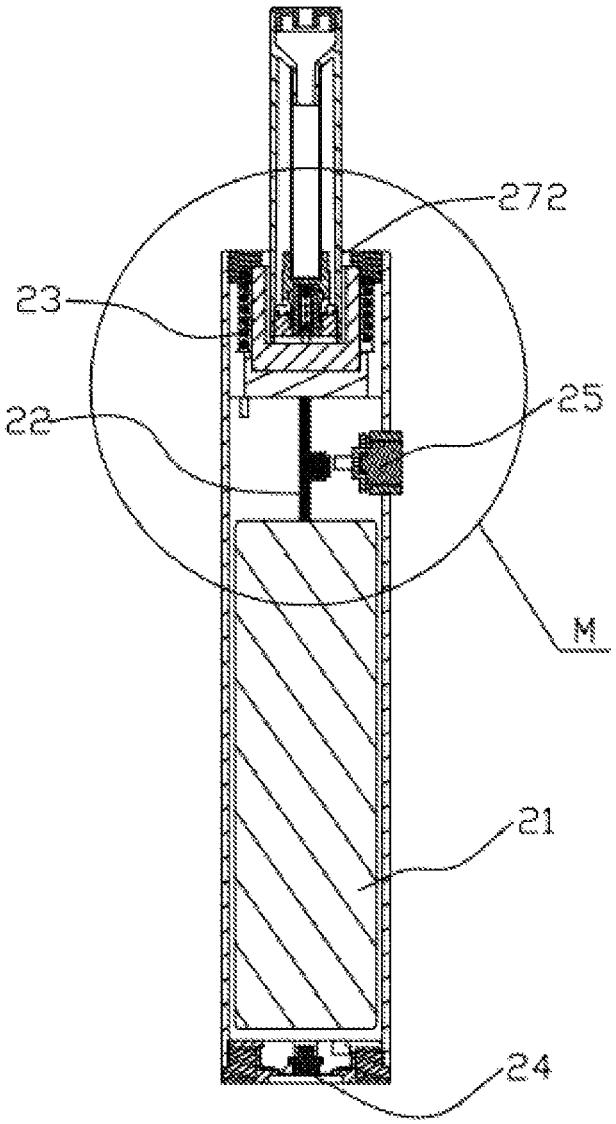
FIG. 2 is a cross-sectional view of the electronic cigarette of electromagnetic heating according to an embodiment of the present disclosure.
Figure 3:
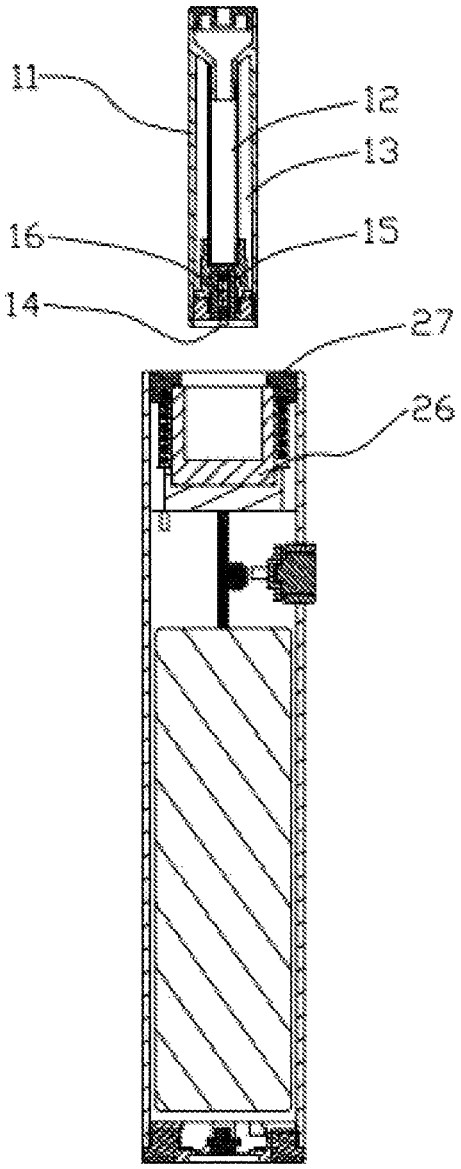
FIG. 3 is an exploded cross-sectional view of the electronic cigarette of electromagnetic heating according to an embodiment of the present disclosure.
Figure 4:
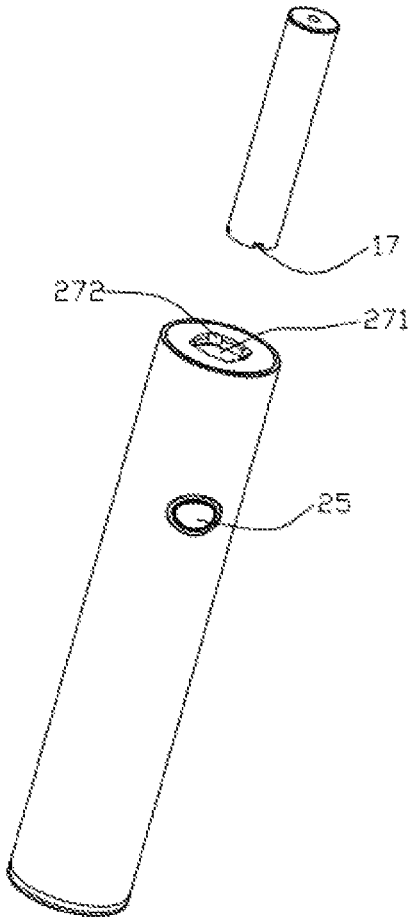
FIG. 4 is an exploded isometric view of the electronic cigarette of electromagnetic heating according to an embodiment of the present disclosure.
Figure 5:
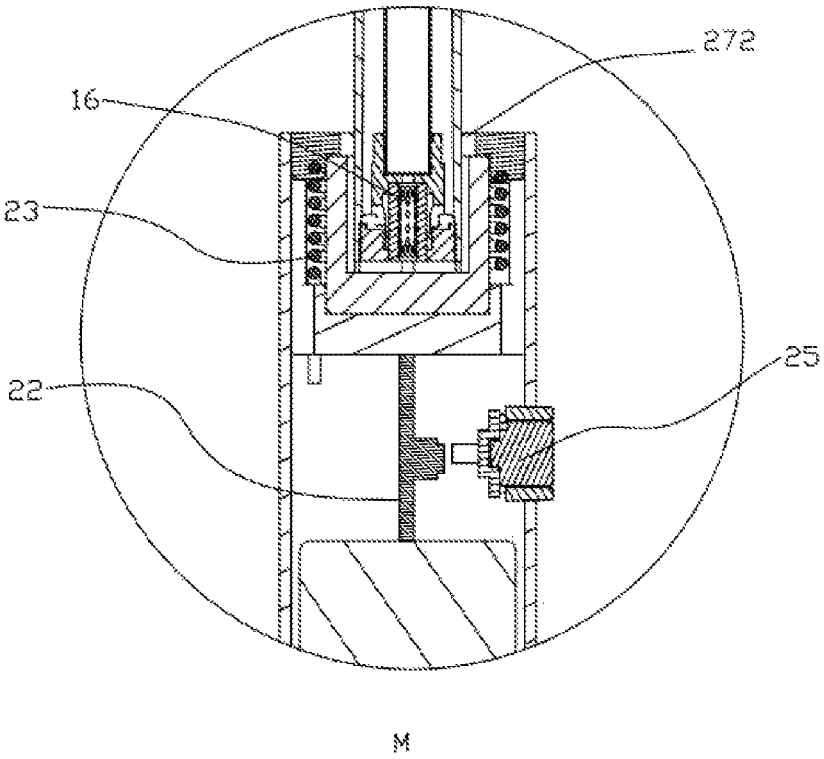
FIG. 5 is a partial enlarged view of the electronic cigarette of electromagnetic heating according to an embodiment of the present disclosure.

As shown form FIG. 1 to FIG. 5, the electronic cigarette of electromagnetic heating in accordance with the present disclosure includes an atomizer 1 and a power supply 2 which are detachably connected. The atomizer 1 has a hollow atomizing tube 11; an aerosol pipe 12 is disposed at a center of the atomizer 1; between the atomizing tube 11 and the aerosol pipe 12 defines a liquid storage chamber 13; an air inlet 14 is disposed at a bottom of the atomizer 1, the air inlet 14 is in communication with the aerosol pipe 12. A liquid conductor 15 is disposed between the air inlet 14 and the aerosol pipe 12, the liquid conductor 15 is a hollow circular structure, and is in communication with the liquid storage chamber, such as the liquid conductor 15 may be a liquid conducting cotton or porous ceramic body. Inner wall of the liquid conductor 15 has a metallic net 16, when the metallic net 16 is heated, the tobacco liquid adsorbed by the metallic net 16 is aerosolized, then sucked by the user.

The power supply 2 includes a built-in battery cell 21, a control circuit board 22, an induction coil 23, a charging seat 24 and a switching button 25. The charging seat 24 is disposed on a lowest end of the power supply, used to supply electricity to the battery cell 21. The control circuit board 22 is connected with the battery cell 21 and the induction coil 23. The switching button 25 is disposed outside the power supply 2 for the user to switch on/off the control circuit board 22, ultimately, to switch on/off the induction coil 23.

A recess is disposed on a top of the power supply 2, a cup body 26 is disposed inside the recess. The induction coil 23 surrounds the cup body 26, an inner diameter of the cup body 26 is greater than an outer diameter of the atomizer 1. After the atomizer 1 is received in the cup body 26, between an outer wall of the atomizer 1 and an inner wall of the cup body 26 there should be a clearance. The cup body 26 is made of non-metallic material, after the bottom end of the atomizer 1 is inserted into the cup body 26, the induction coil 23 generates an inducted magnetic field by activating the switching button 25, the metallic net 16 inside the atomizer 1 cuts magnetic-curves and generates heat to aerosol the tobacco liquid. A cover body 27 is disposed above the cup body 26, used to compress the cup body 26 and the induction coil 23 for fixing them. A mid-part of the cover body 27 has a through hole 271, a diameter thereof allows the bottom end of the atomizer 1 to be inserted into. To avoid the inducted magnetic field generated by the induction coil 23 being blocked or adsorbed by other components, the bottom end of the atomizer 1 inserted into the power supply is made by non-metallic materials, ensuring the heating metallic net 16 is the only component to cut the magnetic-curves, the heat generated by the magnetic field may focus on the metallic net 16, therefore ensuring maximum use of the heat generated by the magnetic field.

In addition, the bottom of the atomizer 1 comprises a side hole 17, the side hole 17 is communicated with the air inlet 14, the number of the side holes 17 may be only one or a plurality. The side hole 17 is configured for ensuring the inletting of air after the atomizer 1 is received in the cup body 16 and a bottom of the atomizer 1 entirely contacts the cup body 16. The cover component 27 further has a plurality of ancillary holes 272 distributed around the through hole 271. The number of the ancillary holes 272 may be one or multiple. The through hole 271 is sized to match with an outer diameter of the atomizer 1, ensuring a certain stability after the bottom end of the atomizer 1 is received in the cup body 26, without shaking therebetween. In this case, a clearance between the cup component 27 and the atomizer 1 is little, once the incoming air is delayed the ancillary holes 272 may effectively solve a problem of the air inletting.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An electronic cigarette of electromagnetic heating comprising:

an atomizer; and a power supply;

wherein, the atomizer comprises a hollow liquid conductor, an inner wall of the liquid conductor comprises a metallic net; a recessed cup body is disposed on a top of the power supply; an induction coil surrounds outside the recessed cup body, a bottom end of the atomizer is disposed in the cup body.

2. The electronic cigarette of electromagnetic heating according to claim 1, wherein the atomizer comprises a hollow atomizing tube; an aerosol pipe is disposed at a mid-part of the atomizer; a liquid storage chamber is defined between the atomizing tube and the aerosol pipe; an air inlet is disposed at a bottom of the atomizer, the air inlet is in communication with the aerosol pipe.

3. The electronic cigarette of electromagnetic heating according to claim 2, wherein the liquid conductor is disposed between the air inlet and the aerosol pipe; the liquid conductor is a hollow circular structure, and is in communication with the liquid storage chamber.

4. The electronic cigarette of electromagnetic heating according to claim 2, wherein the bottom of the atomizer comprises a side hole, the side hole is communicated with the air inlet.

5. The electronic cigarette of electromagnetic heating according to claim 1, wherein the liquid conductor is a liquid conducting cotton or a porous ceramic body.

6. The electronic cigarette of electromagnetic heating according to claim 1, wherein the power supply further comprises a built-in battery cells, a control circuit board, a charging seat and a switching button.

7. The electronic cigarette of electromagnetic heating according to claim 6, wherein the charging seat is disposed at a lowest end of the power supply, and is configured for charging the battery cells; the control circuit board is connected with the battery cells and the induction coil; the switching button is disposed outside the power supply.

8. The electronic cigarette of electromagnetic heating according to claim 1, wherein a recess is disposed on a top of the power supply, the cup body is disposed inside the recess, an inner diameter of the cup body is greater than an outer diameter of the atomizer.

9. The electronic cigarette of electromagnetic heating according to claim 8, wherein a cover component is disposed on a top of the cup body, the cover component is used to compact the cup body and the induction coil tightly.

10. The electronic cigarette of electromagnetic heating according to claim 9, wherein a through hole is disposed at a mid-part of the cover component, a diameter of the through hole allows the bottom end of the atomizer to be inserted into; the cover component further has a plurality of ancillary holes distributed around the through hole.

* * * * *